US005601243A

United States Patent [19]

Inagaki

[11] Patent Number: 5,601,243

[45] Date of Patent: Feb. 11, 1997

[54] PACKAGE OF TERMINAL SERIES STRIP

[75] Inventor: Masaki Inagaki, Yokkaichi, Japan

[73] Assignee: Sumitomo Wiring Systems, Ltd., Japan

[21] Appl. No.: 324,917

[22] Filed: Oct. 18, 1994

[30] Foreign Application Priority Data

Nov. 4, 1993 [JP] Japan ..... 5-301071

[51] Int. Cl.[6] ..... B65H 75/28; B65D 73/02

[52] U.S. Cl. ..... 242/160.2; 242/530.2; 242/532.3; 242/532.1; 242/582; 206/713

[58] Field of Search ..... 242/160.2, 160.1, 242/530.2, 532.3, 532.1, 582, 583; 206/330, 345, 346, 347, 389; 53/118, 119, 430

[56] References Cited

U.S. PATENT DOCUMENTS

| | | | |
|---|---|---|---|
| 2,460,343 | 2/1949 | Foster | 242/582 X |
| 3,049,312 | 8/1962 | Simjian | 242/530.2 X |
| 3,443,683 | 5/1969 | Felty, Jr. et al. | 206/330 X |
| 4,069,916 | 1/1978 | Fowler et al. | 206/330 |
| 4,165,807 | 8/1979 | Yagi | 206/330 X |
| 4,631,897 | 12/1986 | Slavicek | 206/330 X |
| 5,280,862 | 1/1994 | Oya et al. | 242/532.1 |
| 5,340,051 | 8/1994 | Goodfellow | 242/583 X |

FOREIGN PATENT DOCUMENTS

| | | | |
|---|---|---|---|
| 3106762 | 5/1991 | Japan | 242/160.2 |
| 23743 | 2/1993 | Japan . | |

*Primary Examiner*—John M. Jillions

*Attorney, Agent, or Firm*—Jordan B. Bierman; Bierman and Muserlian

[57] ABSTRACT

This invention aims to provide a package of a terminal series strip which can make full use of the last terminal metal fixture 11 on a leading end of a terminal series strip 10 wound around a bobbin 14 as a package. The leading end of the terminal series strip 10 is connected through an auxiliary strap 17 to the bobbin 14. Even if the leading end is paid out from the bobbin 14 after the terminal series strip 10 has been almost paid out from the bobbin 14, the auxiliary strap 17 is maintained to be connected to the bobbin 14. Thus, the terminal series strip 10 can be maintained to be hung between the bobbin 14 and a crimping apparatus until the last terminal metal fixture 11 on the terminal series strip 10 is press-worked.

3 Claims, 2 Drawing Sheets

PACKAGE OF TERMINAL SERIES STRIP

BACKGROUND OF THE INVENTION

1. Field of the Invention

This invention relates to a package of a terminal series strip which is supplied to a crimping apparatus which crimps a terminal metal fixture on a distal end of an electrical wire.

2. Statement of the Prior Art

For convenience of explanation, a conventional package of a terminal series strip will be described below by referring to FIG. 5. FIG. 5 is a side elevational view of a conventional package of a terminal series strip.

A terminal metal fixture is crimped on the distal end of an electrical wire to be inserted into a male connector housing or a female connector housing. The terminal metal fixtures are supplied to the crimping apparatus in order to crimp the terminal metal fixture onto the electrical wire. For example, as shown in FIG. 5, a terminal series strip 50 on which many terminal metal fixtures 51 are united in parallel through elongate carriers 52 is wound around a core 54*a* of a bobbin 54 together with an intermediate layer sheet 53 for preventing the terminal metal fixture 51 from getting caught, thereby forming a package. Paying out the terminal series strip 50 from the bobbin 54 is carried out by drawing the strip 50 from the side of the crimping apparatus not shown while the terminal series strip 50 is hung between the bobbin 54 and the crimping apparatus. As the bobbin 54 is rotated under tension acting on the terminal series strip 50, the strip 50 is supplied from the bobbin 54 to the crimping apparatus. The terminal metal fixtures 51 are separated from the strip 50 one after another and the separated terminal metal fixture 51 is crimped on an electrical wire not shown in the crimping apparatus.

In order to connect the terminal series strip 50 in the package to the bobbin, heretofore as shown in FIG. 5, leading ends of the terminal series strip 50 and intermediate layer sheet 53 are secured through adhesive tapes 55 and 56 to the core 54*a*, respectively. In this case, when the top of the leading end of the terminal series strip 50 exits from an outer periphery of the bobbin 54*a*, the tension acting on the terminal series strip 50 is increased. Thus, the terminal series strip 50 is stretched, so that the leading end is stripped from the adhesive tape 55. Consequently, the terminal series strip 50 exits from the bobbin 54 and is drawn to the side of the crimping apparatus.

However, there are the following problems in the conventional manner of coupling the leading end of the terminal series strip 50 to the bobbin 54 directly. The terminal series strip 50 hung between the bobbin 54 and the crimping apparatus is stretched under high tension immediately before the strip 50 exits from the bobbin 54. The leading end of the terminal series strip 50 springs while deflecting after the strip exits the bobbin 54. If the free leading end strikes the crimping apparatus or another peripheral device, the end becomes deformed. Consequently, many terminal metal fixtures within a certain range of length from the leading end on the strip 50 cannot be used. Also, in the case that the free leading end is caught by the crimping apparatus or another peripheral device, operation of the crimping apparatus might be impeded.

SUMMARY OF THE INVENTION

An object of the present invention is to provide a package of a terminal series strip which can make full use of the last terminal metal fixture on a leading end thereof.

In order to achieve the above object, a package of a terminal series strip in accordance with the present invention comprises: a bobbin; a terminal series strip adapted to be wound around the bobbin; a number of terminal metal fixtures arranged in series on the strip; and an auxiliary strap having a given length and connected between a leading end of the strip and the bobbin.

The package may further comprise an intermediate layer sheet adapted to be disposed between the strip wound around the bobbin.

The auxiliary strap may be a second intermediate layer sheet. One end of the sheet is secured to the bobbin and the other end of the sheet is secured to a leading end of the strip.

The auxiliary strap may be a turned-back portion of the intermediate layer sheet. A folded portion of the sheet is secured to the bobbin.

The auxiliary strap may be a portion extending from the leading end of the strip.

A trailing end of the terminal series strip wound on the bobbin is drawn out from the bobbin to be set in a crimping apparatus. Then, the terminal series strip drawn out of the bobbin is hung between the bobbin and the crimping apparatus. When the crimping apparatus is driven to start crimping the terminals, the terminal series strip is pulled to the side of the crimping apparatus to be successively paid out from the bobbin.

Even if the terminal series strip is paid out from the bobbin until the leading end of the strip exits the bobbin, the strip is kept in a hung state between the crimping apparatus and the bobbin so that the terminal metal fixtures can be supplied to the crimping apparatus, since the auxiliary strap is connected to the bobbin. For example, when the last terminal metal fixture on the strip is press-worked, a sensor detects this action and generates a signal to stop the crimping apparatus. That is, the terminal series strip is maintained to be hung between the bobbin and the crimping apparatus until the crimping process of the strip ceases. Then, a new terminal series strip is set on the crimping apparatus and the crimping work of terminals is begun again.

According to the present invention, since the auxiliary strap is connected between the leading end of the terminal series strip and the bobbin, the strip can be hung between the bobbin and the crimping apparatus until the leading end of the strip reaches the crimping apparatus. Thus, it is possible to supply the leading end of the strip to the crimping apparatus and to prevent terminal metal fixtures from being dropped.

DETAILED DESCRIPTION OF THE PREFERRED EMBODIMENTS

Figure 1:
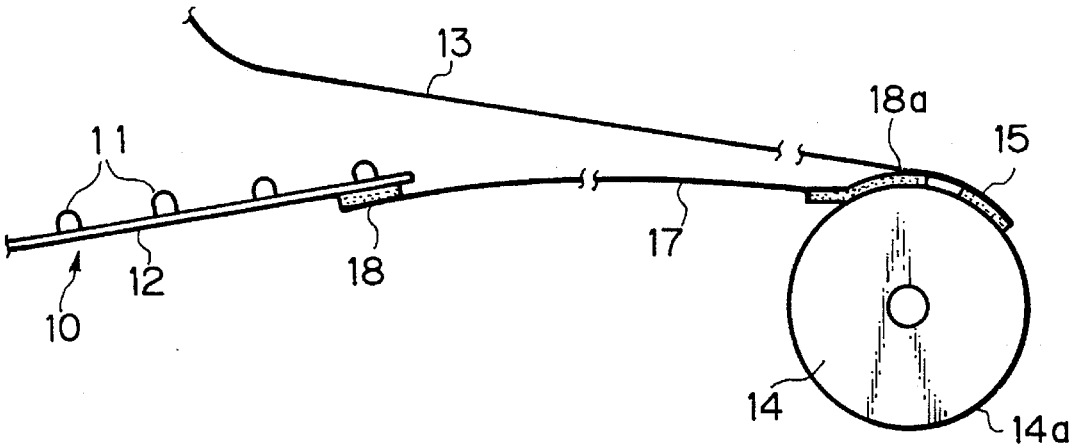
FIG. 1 is a side elevational view of a first embodiment of a package of a terminal series strip in accordance with the present invention.

Referring now to the drawings, preferred embodiments of a package of a terminal series strip in accordance with the present invention will be described below.

<First Embodiment>

FIG. 1 shows a first embodiment of a package of a terminal series strip of the present invention.

The package of this embodiment is rotatably mounted on a bobbin support axle attached to a crimping apparatus not shown. Then, a terminal series strip 10 is drawn from a bobbin 14 and hung between the bobbin and the crimping apparatus.

In the first embodiment, the terminal series strip 10 is produced by punching and bending a longitudinal half of a conductive metal strip to form a carrier 12 on one longitudinal half of the strip and many terminal metal fixtures 11 projecting from a side of the longitudinal half of the strip in parallel to each other.

The bobbin 14 around which the terminal series strip 10 is wound comprises a cylindrical core 14*a* which has a length greater than a width of the strip 10 and side discs (not shown) attached to the opposite ends of the core so as to clamp the strip 10.

A leading end of an intermediate layer sheet 13 is attached to the core 14*a* of the bobbin 14 through a duplicated adhesive tape 15. The intermediate layer sheet 13 is disposed between turns of the strip 10 around the bobbin 14 so as to prevent the terminal metal fixtures 11 from catching each other. The intermediate layer sheet 13 has the same width and length as those of the strip 10. The sheet 13 is drawn from the bobbin 14 as the strip 10 is drawn from the bobbin 14 and the sheet 13 is taken up by a take-up means (not shown) independently upon the strip 10.

A leading end of an auxiliary strap 17 made of an elongate paper is attached to the core 14*a* through a duplicated adhesive tape 18*a*. A leading end of the terminal series strip 10 is attached to a trailing end of the auxiliary strap 17 through a duplicated adhesive tape 18. A length of the auxiliary strap 17 is set to be longer than a distance from the core 14*a* to the crimping apparatus. The leading end of the strip 10 can be drawn by the auxiliary strap 17 to a position apart from the core 14*a* by a distance greater than the distance between the core 14*a* and the crimping apparatus.

Next, an operation of the first embodiment will be described below.

The terminal series strip 10 hung between the bobbin 14 and the crimping apparatus is successively drawn from the bobbin 14 as the crimping work of terminals is progressed. Drawing of the strip 10 is advanced and the leading end of the strip 10 leaves from the core 14*a*. Thereafter, the strip 10 is drawn to the crimping apparatus. However, since the leading end of the strip 10 is connected through the auxiliary strap 17 to the core 14*a*, the strip 10 can be supplied to the crimping apparatus while the strip 10 is maintained to be hung between the bobbin 14 and the crimping apparatus.

When the top of the leading end of the strip 10 approaches the crimping apparatus, a sensor (not shown) disposed near the apparatus detects the last terminal metal fixture 11. In response to detection of the last terminal metal fixture works of drawing the strip 10 to the crimping apparatus, separating the terminal metal fixtures 11 from the carrier 12, and crimping the separated terminal metal fixture 11 onto the distal end of the electrical wire are stopped. Then, supplying the strip 10 to the crimping apparatus is finished.

Thus, in the first embodiment, the leading end of the terminal series strip 10 is coupled through the auxiliary strap 17 to the core 14*a*. The strip 10 is maintained is a hung state between the bobbin and the crimping apparatus until the top of the leading end of the strip 10 reaches the crimping apparatus. Accordingly, it is possible to stably supply the whole strip 10 including the leading end to the crimping apparatus. That is, it is possible to prevent the leading end of the strip 10 from leaving the core 14*a*. Thus, it is possible to prevent terminal metal fixtures from being dropped.

<Second Embodiment>

Figure 2:
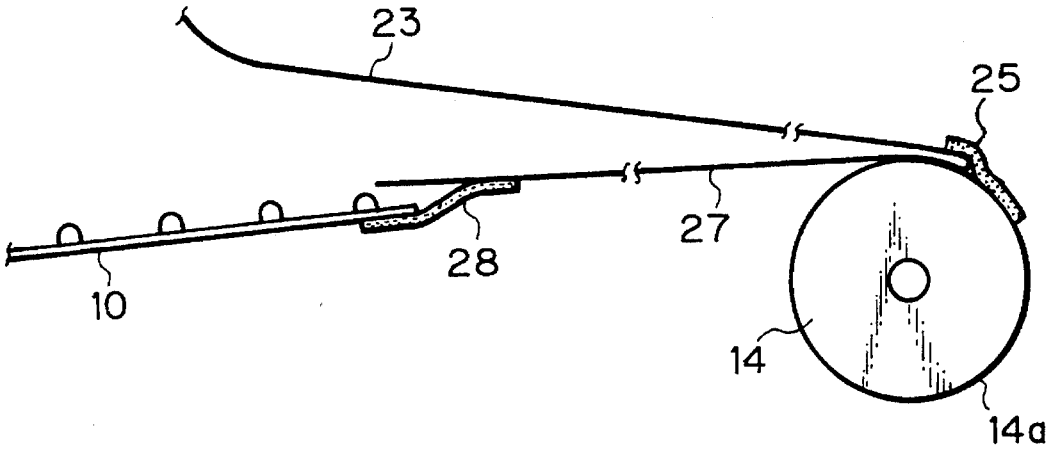
FIG. 2 is a side elevational view of a second embodiment of the package of the present invention.

FIG. 2 shows a second embodiment of a package of a terminal series strip of the present invention.

Since the terminal series strip in the second embodiment is the same as that in the first embodiment, only the differences in construction between the embodiments are described below.

An intermediate layer sheet 23 is turned back inwardly at a position apart from the crimping apparatus by a distance longer than the distance between the bobbin 14 and the crimping apparatus. The folded portion of the sheet 23 is attached through an adhesive tape 25 to an outer periphery of the core 14*a*. The turned-back portion of the sheet 23 becomes an auxiliary strap 27. A leading end of the terminal series strip 10 is connected through an adhesive tape 28 to a free end of the auxiliary strap 27. That is, the strip 10 is connected to the bobbin 14 through the auxiliary strap 27 formed by turning back the sheet 23. The auxiliary strap 27 is eventually longer than a distance between the core 14*a* and the crimping apparatus.

In the second embodiment, it is possible to form the auxiliary strap 27 by merely turning back the sheet 23 and thus it is not necessary to provide an individual auxiliary strap. Since the adhesive tape 25 can attach the sheet 23 to the core 14*a*, the number of parts can be decreased and the attaching work can be simplified.

<Third Embodiment>

Figure 3:
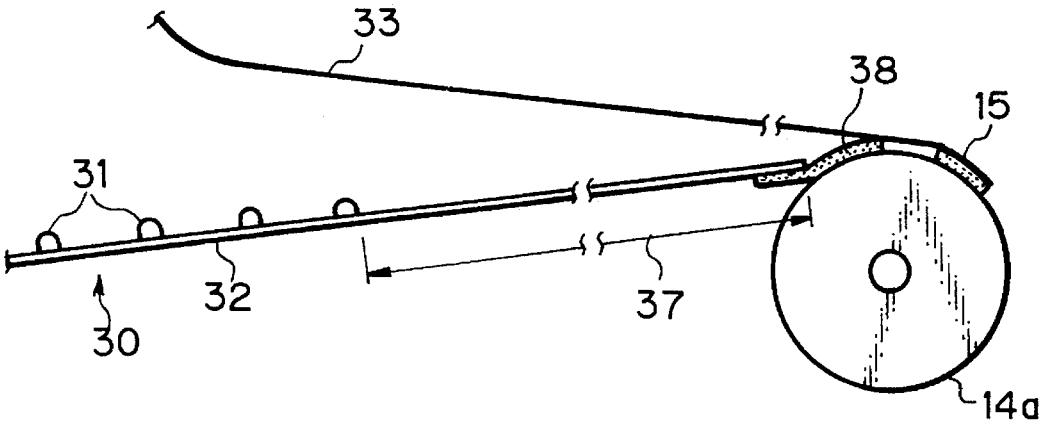
FIG. 3 is a side elevational view of a third embodiment of the package of the present invention.

FIG. 3 shows a third embodiment of a package of a terminal series strip of the present invention.

Since a construction in the third embodiment is substantially the same as that in the first embodiment, differences between them are mainly described below.

A terminal series strip 30 in the third embodiment is produced by punching and bending a longitudinal half of a conductive metal strip to form a continuous strip like carrier 32 on the half of strip and many terminal metal fixtures 31 projecting from the side of the half in parallel to each other. The strip 30 is provided on its end with a portion which is neither punched nor bent through a length longer than a distance from the core 14*a* to the crimping apparatus. In the third embodiment, this unworked portion of the strip 30 becomes an auxiliary strap 37. A leading end of the auxiliary strap 37 is attached to the core 14*a* through a duplicated adhesive tape 38. That is, a leading end of the strip 30 is attached to the core 14*a* through the auxiliary strap 30 formed of the unworked portion of the strip 30.

An intermediate layer sheet 33 in the third embodiment is the same as that in the first embodiment. A leading end of the sheet 33 is attached to the core 14*a* through a duplicated adhesive tape 15. The sheet 33 is disposed between turns of strip 30 wound around the core 14*a* to prevent the terminal metals 11 from catching each other.

The duplicated adhesive tapes 38 and 15 are attached to the different positions on the outer periphery of the core 14*a*.

In the third embodiment, it is not necessary to provide the individual auxiliary strap 37 since the unworked portion becomes the auxiliary strap 37 upon producing the strip 30. Further, the number of parts is decreased and the attaching work is simplified, since the auxiliary strap 37 is united to the strip 30.

<Fourth Embodiment>

Figure 4:
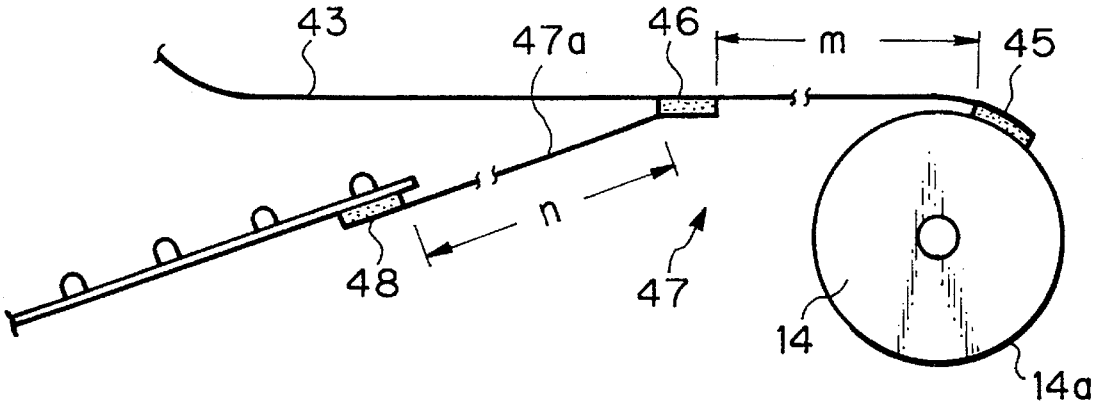
FIG. 4 is a side elevational view of a fourth embodiment of the package of the present invention.
Figure 5:
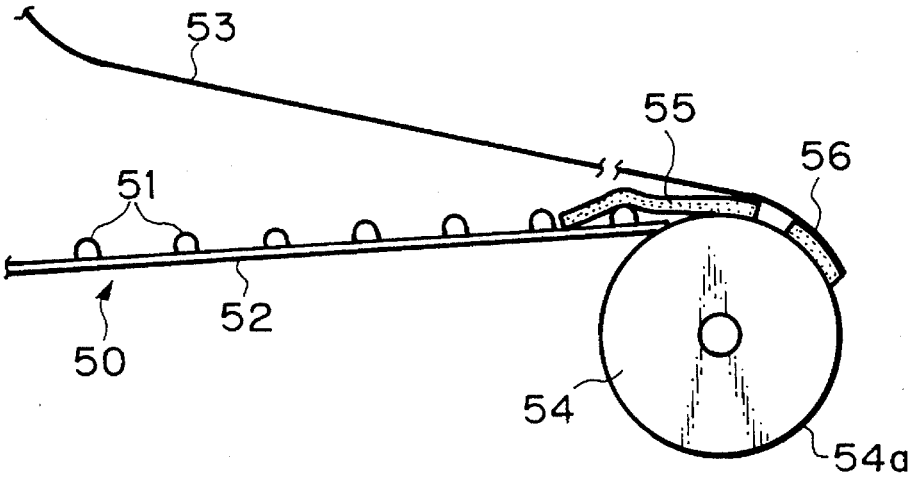
Fig. 5 PRIOR ART
FIG. 5 is a side elevational view of a conventional package of a terminal series strip.

FIG. 4 shows a fourth embodiment of a package of a terminal series strip of the present invention.

Since the construction of the fourth embodiment is same as that of the first embodiment, only the differences between them are described below.

A leading end of an intermediate layer sheet 43 is attached through a duplicated adhesive tape 45 to the core 14*a*. A leading end of an auxiliary strap 47*a* made of an elongate paper having a length n is attached through a duplicated adhesive tape 46 to an inner face of the sheet 43 at a position apart from the leading end of the sheet 43 by a distance m. A leading end of a terminal series strip 50 is attached through a duplicated adhesive tape 48 to an outer face of a trailing end of the auxiliary strap 47*a*. A total length (m+n) of the united auxiliary strap 47 is longer than a distance from the core 14*a* to the crimping apparatus. The united auxiliary strap 47 includes a portion of the sheet 43 having a length m from the leading end of the sheet 43 and the auxiliary strap 47*a* having a length n. That is, the leading end of the strip 50 can be drawn to the position (m+n) from the core 14*a* through the auxiliary strap 47.

In the fourth embodiment, it is possible to easily carry out the crimping work of terminal metal fixtures without greatly altering a producing machine of the terminal series strip and a packing machine of the strip since the auxiliary strap 47*a* is attached to the intermediate portion of the sheet 43.

Although the auxiliary strap is made of paper or metal in the above embodiments, the strap may be made of cloth, resin or the like. Also, although the adhesive tape is used as attaching means for the core, strip and strap in the above embodiment, adhesion, threading, insertion and the like may be used for the attaching means.

The present invention should not be limited to the above embodiments described above and illustrated in the drawings. The present invention may be carried out without departing from the spirit of the invention.

What is claimed is:

1. A package comprising a bobbin, a strip adapted to be wound around said bobbin, a plurality of terminals spaced longitudinally apart on said strip, a first intermediate layer sheet adapted to be disposed between successive coils of said strip wound around said bobbin, an auxiliary strap of predetermined length extending between a leading end of said strip and said bobbin, said auxiliary strap being a turned-back portion of said first intermediate layer sheet, and a folded portion secured to said bobbin.

2. The package of claim 1 wherein said auxiliary strap is a second intermediate layer sheet and one end of said second layer sheet is secured to said bobbin and another end of said second sheet is secured to said leading end of said strip.

3. The package of claim 1 wherein said auxiliary strap extends from a leading end of said strip.

* * * * *